United States Patent [19]

Temprano et al.

[11] Patent Number: 4,787,962

[45] Date of Patent: Nov. 29, 1988

[54] METHOD OF ELECTROLYTICALLY DEPOSITING METAL ON TITANIUM

[75] Inventors: Serge Temprano, Eaunes; Bernard Artéro, Cugnaux, both of France

[73] Assignee: Alcatel Espace, Courbevoie Cedex, France

[21] Appl. No.: 53,895

[22] Filed: May 26, 1987

[30] Foreign Application Priority Data

May 26, 1987 [FR] France ..... 86 07475

[51] Int. Cl.[4] ..... C25D 5/34

[52] U.S. Cl. ..... 204/32.1; 204/38.5; 204/40; 204/141.5

[58] Field of Search ..... 204/32.1, 40, 38.5, 204/129.75, 141.5

[56] References Cited

U.S. PATENT DOCUMENTS 3,632,490 1/1972 Covington ..... 204/32.1
4,127,709 11/1978 Ruben ..... 204/32.1
4,412,892 11/1983 Chen et al. ..... 204/32.1

OTHER PUBLICATIONS

English Translation of Khorozova et al, the Effect of Preliminary Treatment of the Support on the Electrocatalytic Activity of a Platinized Titanium Catalytic Electrode corresponding to CA 105:68875f (1986)–Complete English Translation of Full Literature Reference Submitted Herewith.

*Primary Examiner*—R. L. Andrews
*Attorney, Agent, or Firm*—Sughrue, Mion, Zinn, Macpeak and Seas

[57] ABSTRACT

A method of electrolytically depositing metal on titanium, includes a pickling step using sulfuric acid at 95% RP, with the temperature of the bath lying between 30° C. and 80° C., with the concentration lying between 20% and 80% in water, and with the immersion time lying between 30 seconds and 5 minutes.

4 Claims, No Drawings

METHOD OF ELECTROLYTICALLY DEPOSITING METAL ON TITANIUM

At present there are few really reliable techniques for processng titanium electrolytically.

BACKGROUND OF THE INVENTION

The most frequently used technique consists in pickling the titanium in pure hydrochloric acid at 90° C. and then passing it through chlorosulfonic acid. However, when this technique is used, the adherence defect rate on the base material due to the rapid oxidation of titanium is greater than 50%.

The aim of the invention is to mitigate these drawbacks.

SUMMARY OF THE INVENTION

The present invention provides a method of electrolytically depositing metal on titanium, the method including a pickling step using sulfuric acid at 95% RP, with the temperature of the bath lying between 30° C. and 80° C., with the concentration lying between 20% and 80% in water, and with the immersion time lying between 30 seconds and 5 minutes.

More precisely, the method of the invention comprises the following steps:

chemical degreasing followed by washing;
electrolytic degreasing followed by washing;
pickling used said 95% RP sulfuric acid followed by rapid washing;
depositing an underlayer of nickel; and
depositing a final layer (gold, silver, . . . ).

The new method thus consists in a change in the pickling, with the new pickling step providing a success rate of about 99%, and satisfying the severe requirements of the standards laid down for space equipment: in particular with respect to good adherence over a temperature range of −100° C. to +260° C.

In addition, this method considerably reduces handling time (by about 30%) and materials costs (by about 50%).

The characteristics and advantages of the invention also appear from the following description given by way of nonlimiting example.

Titanium is used in the aerospace industry, for example, as a thin- or thick- film microelectric support on a ceramic, because of various properties specific to titanium: in particular, it is light and non-magnetic. Further, its coefficient of expansion matches that of the ceramics onto which it is to be soldered.

However, it is not possible to solder ceramic on titanium at low temperature. A metal deposit (gold, silver, . . . ) is therefore made on its surface. This makes it possible to obtain excellent surface electric conductivity at high frequencies.

The method of the invention consists in pickling titanium, and in particular T40 grade titanium. This pickling process has the following characteristics:

nature of the pickling substance: 95% RP ("recta pura" ) sulfuric acid;
temperature of the bath: 30° C. to 80° C.;
concentration: 20% to 80% in water; and
immersion time: 30 seconds to 5 minutes.

Naturally this pickling process may also be applied to other grades of titanium within the scope of the present invention.

Such treatment reduces adherence defects of an underlayer of nickel on titanium. It improves the adherence of an electrolytic deposit of a metal such as gold, silver, or copper, . . . on said nickel bonding layer. Such a method may be used, in particular, in the aerospace industry.

The treatment of titanium thus comprises the following steps:

chemical degreasing followed by washing;
electrolytic degreasing followed by washing;
pickling using the method of the invention followed by rapid washing (between 15 seconds and 20 seconds);
depositing an underlayer of nickel, either by:
  mat nickel electroplating (immersing the parts under tension in the bath at 3 amps per $dm^2$, for example); or
  chemical nickel plating; and
optionally depositing a final metal layer of a metal such as gold, silver, copper, . . . .

Naturally, the present invention has been described and shown solely by way of preferred example, and numerous modifications are possible for the person skilled in the art without going beyond the scope of the claims.

We claim:

1. A method of electrolytically depositing metal on titanium comprising the following steps:

chemical degreasing followed by washing;
electrolytic degreasing followed by washing;
pickling using sulfuric acid at 95% RP, with the temperature of the bath lying between 30° C. and 80° C., with the concentration lying between 20% and 80% in water, and with the immersion time lying between 30 seconds and 5 minutes;
depositing an underlayer of nickel; and
depositing a final layer.

2. A method according to claim 1, wherein the underlayer of nickel is deposited by nickel electroplating.

3. A method according to claim 1, wherein that the underlayer of nickel is deposited by chemical nickel plating.

4. A method according to claim 1, wherein the titanium is T40 titanium.

* * * * *